US006891098B1

(12) United States Patent
Lombardi

(10) Patent No.: US 6,891,098 B1
(45) Date of Patent: May 10, 2005

(54) ANTI-FRICTION DRUM STRAND SELECTIVE TENSIONER

(75) Inventor: Donald G. Lombardi, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 10/346,348

(22) Filed: Jan. 16, 2003

Related U.S. Application Data

(63) Continuation-in-part of application No. 09/976,955, filed on Oct. 15, 2001.

(51) Int. Cl.[7] ..... G10D 13/02
(52) U.S. Cl. ..... 84/415
(58) Field of Search ..... 84/415, 417, 413, 84/411 R, 411 A

(56) References Cited

U.S. PATENT DOCUMENTS 5,616,875 A * 4/1997 Lombardi ..... 84/415
6,093,877 A * 7/2000 Nickel ..... 84/415

* cited by examiner

*Primary Examiner*—Kimberly Lockett
(74) *Attorney, Agent, or Firm*—William W. Haefliger

(57) ABSTRACT

A throw-off device for use on a drum having a side wall and a head, a support body attachable to the side wall of the drum, a tensioning member movable relative to the body to tension or release strands adjacent the drum head, a lever movable between selected positions, cam and follower roller elements that are relatively movable in response to lever movement to effect member movement, and a detent device for releasably holding the member in selected positions, whereby the degree of strand tensioning may be varied and retained at selected positions.

20 Claims, 10 Drawing Sheets

ANTI-FRICTION DRUM STRAND SELECTIVE TENSIONER

This application is a continuation-in-part of prior pending U.S. patent application Ser. No. 09/976,955 filed Oct. 15, 2001.

BACKGROUND OF THE INVENTION

This invention relates generally to drumming apparatus, and more particularly to auxiliary apparatus attachable to a drum, such as a tom-tom, for tensioning and releasing multiple strands that co-act with the drum head to produce desired acoustic effects.

There is need for an improved, simple, effective throw-off device that a drummer may use to quickly tension and/or release strands, such as metal wires, that are used adjacent a drum head to produce certain distinctive acoustic effects, upon beating a drum, as for example a tom-tom drum.

More particularly, there is need for an adjustment that will easily and compactly allow adjustable tensioning of such strands, for tuning of the desired acoustic effects. There is also need for adjustable tensioning of such strands at selected maintained levels.

SUMMARY OF THE INVENTION

It is a major object of the invention to provide improved apparatus meeting the above needs. Basically, the improved apparatus or device of the invention comprises:

a) a support body attachable to the side wall of the drum, b) a tensioning member movable relative to said body to vary tension of strands adjacent the drum head, c) detent means for releasably holding said member in selected positions, whereby the degree of strand tensioning may be varied and retained at selected positions.

As will be seen the tensioning member is typically rotatable, and the detent means blocks rotation of that member in any of a series of rotated positions of the member. The detent means may include a spring urged part sequentially and selectively engageable with surfaces on the rotatable member, and spaced about an axis defined by that member. Also, the tensioning member and the detent means are typically carried by the support body. Further, the detent surfaces are configured to accommodate lengthwise movement relative to the spring urged part, as the tensioning member is rotated. In addition, detenting force may be adjusted, as will be seen.

Another object includes provision of d) a lever movable between selected positions, e) cam and follower roller elements that are relatively movable in response to said lever movement to effect such member movement, f) those elements being typically located in spaced relation to said detent means.

As will be seen, the roller elements desirably take the form of roller bearings, to minimize frictional resistance to quick lever movement. One of the cam and follower roller elements is typically carried by said lever and the other of said elements is carried by said tensioning member. For compactness, the lever typically extends between said tensioning member and said cam; and the cam is located between said lever and one part of said support body attachable to said side wall of the drum; the cam also being protected between the one part and a second part of the support body. Also, the lever projects to be swingable in a plane that is parallel to said cam plate, for compactness.

It is another object to provide two roller guide slots in the cam, for accurate cam and captivated roller guiding action, during lever swinging.

A yet further object is to provide a device as referred to wherein the tensioning member has first and second sections which are relatively movable, one section connected to drum head striking strands, and adjustment means to control such relative movement of said sections to effectively tune the striking action of the strands, when tensioned by movement of the lever.

It is a further object to provide a compact device that includes:

a) first and second components which are relatively moveable, b) drum head striking strands operatively connected to one of said components to be tensioned and de-tensioned in response to such movement, c) a lever having roller bearing operative connection to at least one of said components, to effect said movement thereof, d) and detent means for releasably holding said member in selected positions, whereby the degree of strand tensioning may be varied and retained at selected positions.

These and other objects and advantages of the invention, as well as the details of an illustrative embodiment, will be more fully understood from the following specification and drawings, in which:

DRAWING DESCRIPTION

DETAILED DESCRIPTION

Figure 1:
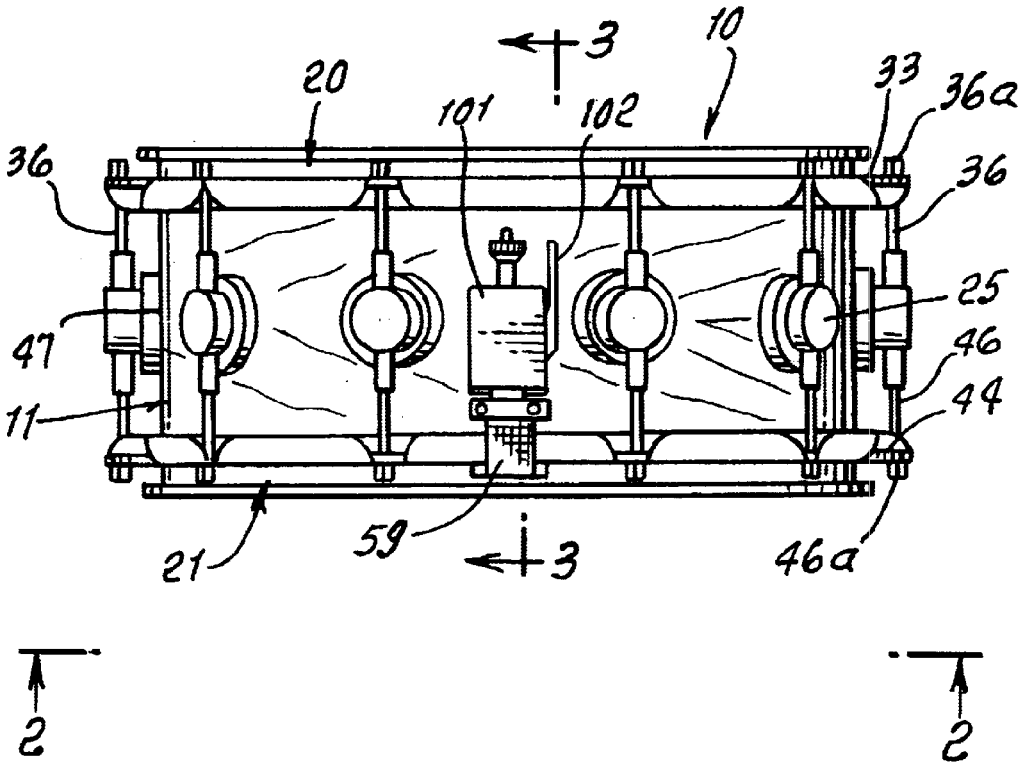
FIG. 1 is a side elevational view of a drum incorporating the invention.
Figure 2:
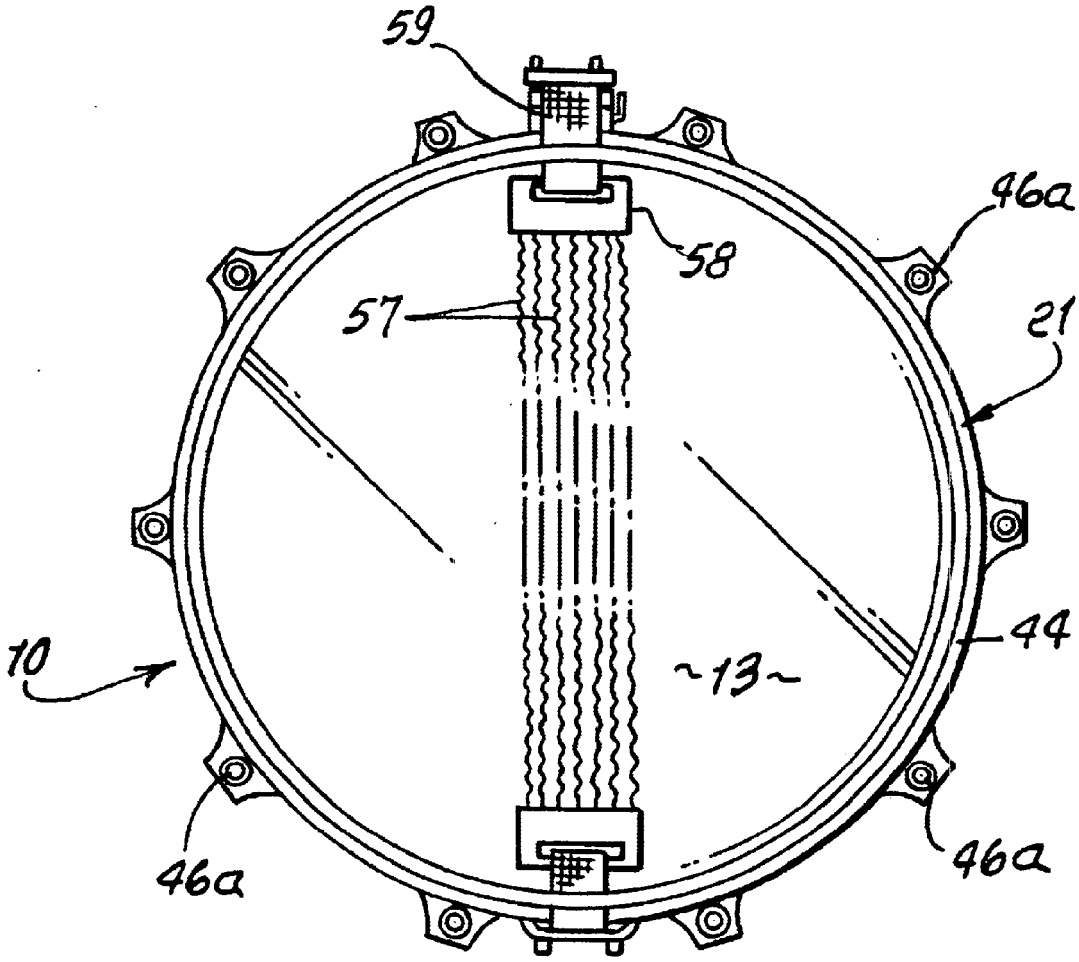
FIG. 2 is a plan view taken on lines 2—2 of FIG. 1.

In the drawings, a drum 10 has a shell 11 comprising a cylindrical section or sections located in axially extending position. Drum 10 may be a tom-tom.

Figure 3:
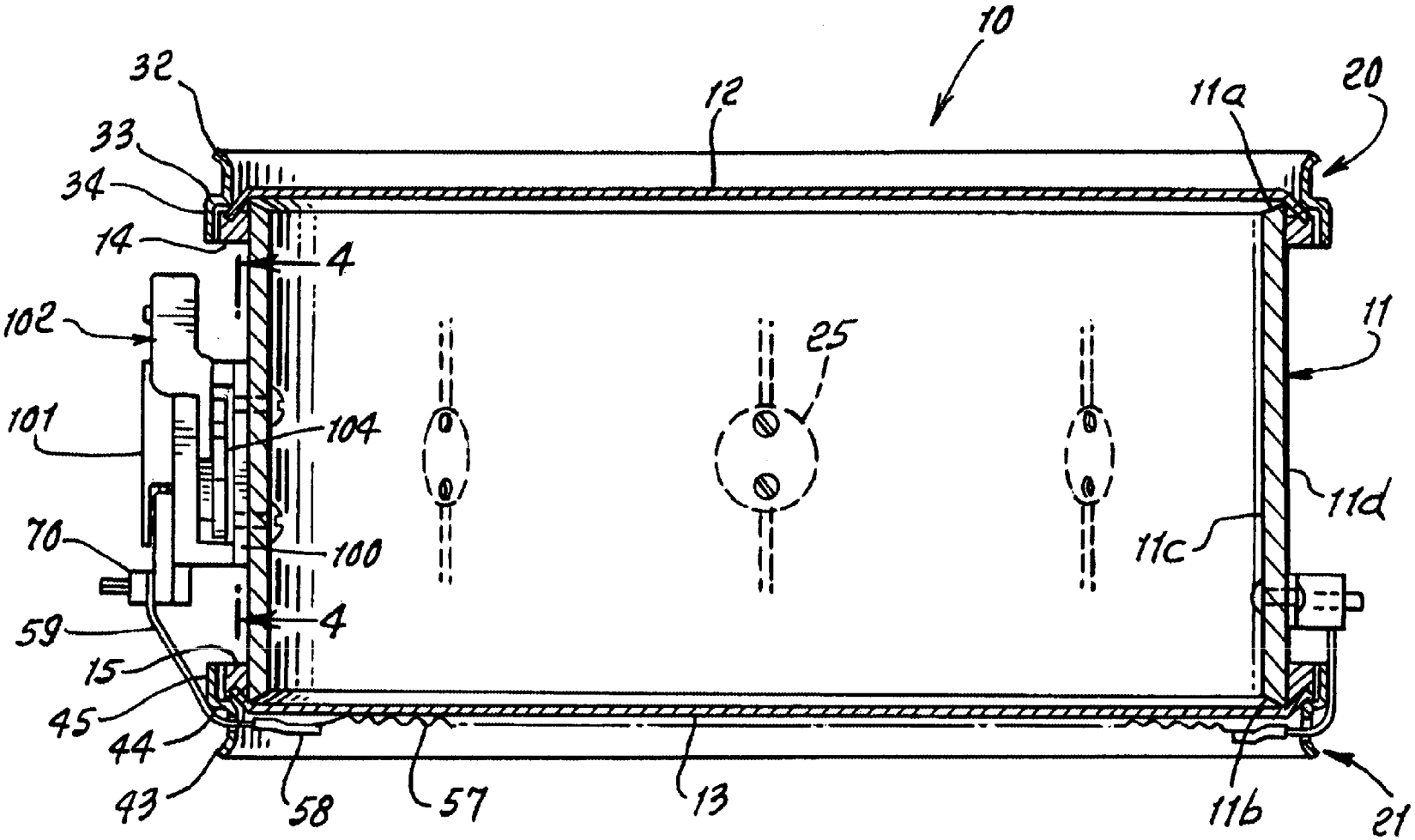
FIG. 3 is an enlarged vertical section taken on lines 3—3 of FIG. 1.

Opposite annular and inwardly angled ends of the shell appear at 11*a* and 11*b* in FIG. 3. The shell typically consists of wood and has inner and outer cylindrical walls 11*c* and 11*d*.

Drum heads 12 and 13 extend over the shell ends 11*a* and 11*b* and are retained in taut condition. They may consist of thin sheets of plastic or other material. Annular metallic flanges 14 and 15 are typically attached to the respective heads 12 and 13 for retaining them in taut condition. Flanges 14 and 15 extend about opposite end extents of the shell, as seen in FIG. 3.

The retainer structure shown includes flange structure 20 provided in association with one end 11*a* of the shell, and flange structure 21 in association with the other end 11*b* of the shell.

The upper flange structure 20 has an upwardly extending annular rim portion 32 extending above the level of drum head 12, a medial annular portion 33 extending radially outwardly below the level of 32, for transmitting head tightening loading to flange 14, and a lower annular extending portion 34 extending downwardly from the outer extent of 33. A tightening adjustment fastener rod 36 extends downwardly through 33 and has external threads that interfit upper internal threads in holder or stud 25. Note fastener head 36*a* bearing on the upper surface of 33 in FIG. 1. The lower surface of 33 exerts downward loading onto retention ring or flange 14 to which drum head 12 is attached, for adjusting its tautness, by drawing the head over 11*a*.

Likewise, lower flange structure 21 has a downwardly extending annular rim portion 43 extending below the level of drum head 13, a medial annular portion 44 extending radially outwardly above the level of 43 for transmitting head tightening loading, and an upper annularly extending portion 45 extending upwardly from outer extent of 44. A tightening adjusting fastener rod 46 extends upwardly through 44 and has external threads that interfit rotatably lower internal threads in holder or stud 25. Note fastener head 46*a* bearing on the lower surface of 44. The upper surface of 44 exerts upward loading onto lower retention ring or flange 15 to which drum head 13 is attached, for adjusting its tautness, i.e. over bevel 11*b*. Fasteners connect 25 to 11 at 47. Accordingly, the drum heads are individually adjustable, and acoustic benefits are enabled, while the drum heads are stretched over metal edges, with acoustic benefits.

Figure 4:
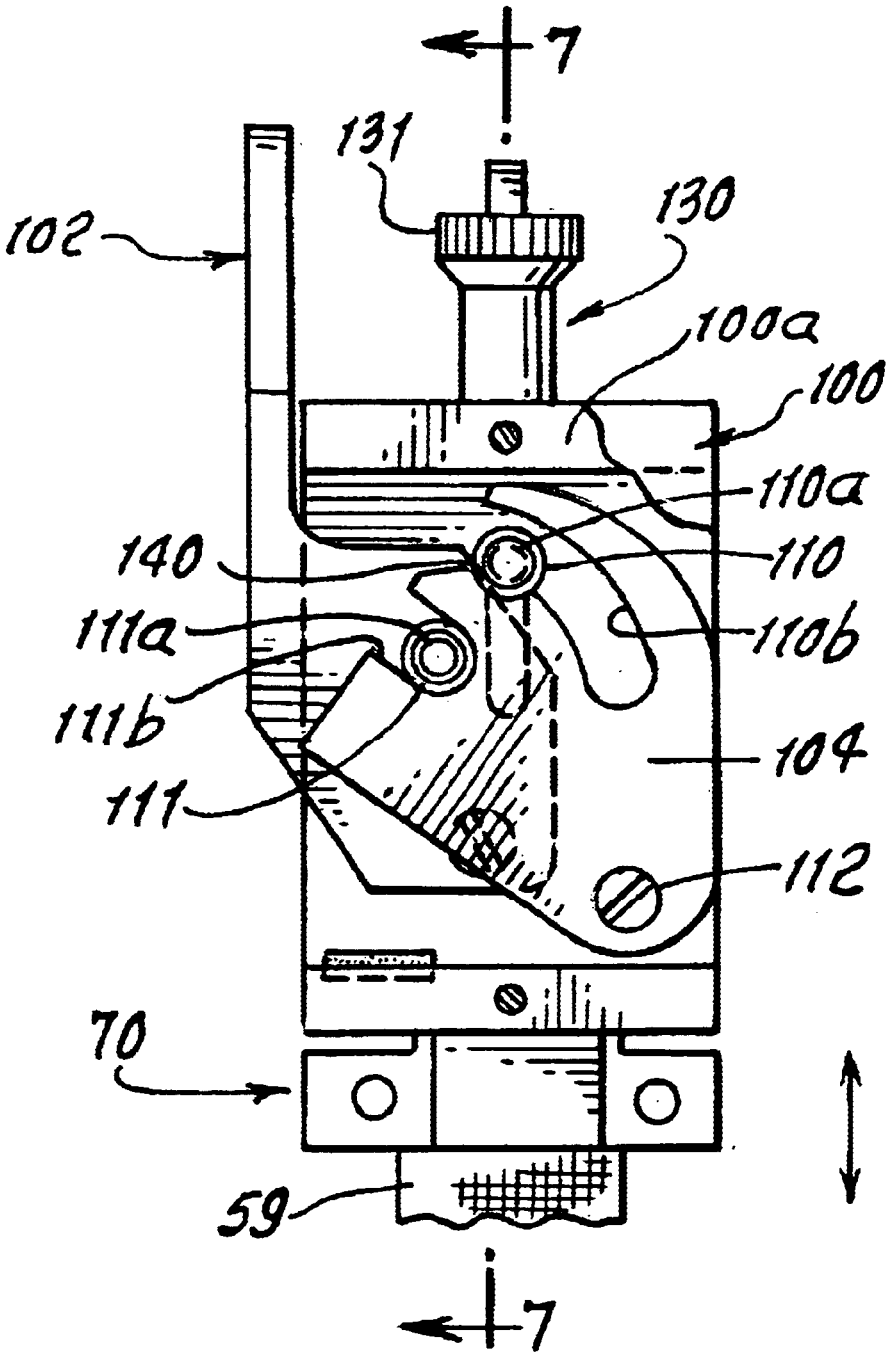
FIG. 4 is an elevation taken on lines 4—4 of FIG. 3 showing lever structure to tension a strap and metal strands adjacent a drum head.
Figure 5:
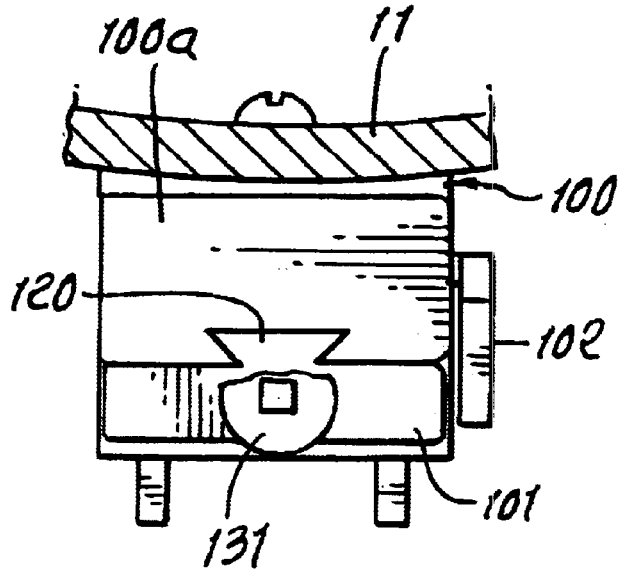
FIG. 5 is a top plan view of the FIG. 4 structure.
Figure 6:
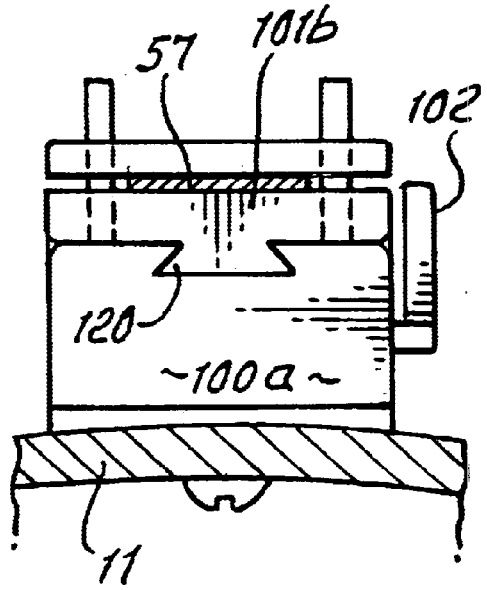
FIG. 6 is a bottom plan view of the FIG. 4 structure.
Figure 9:
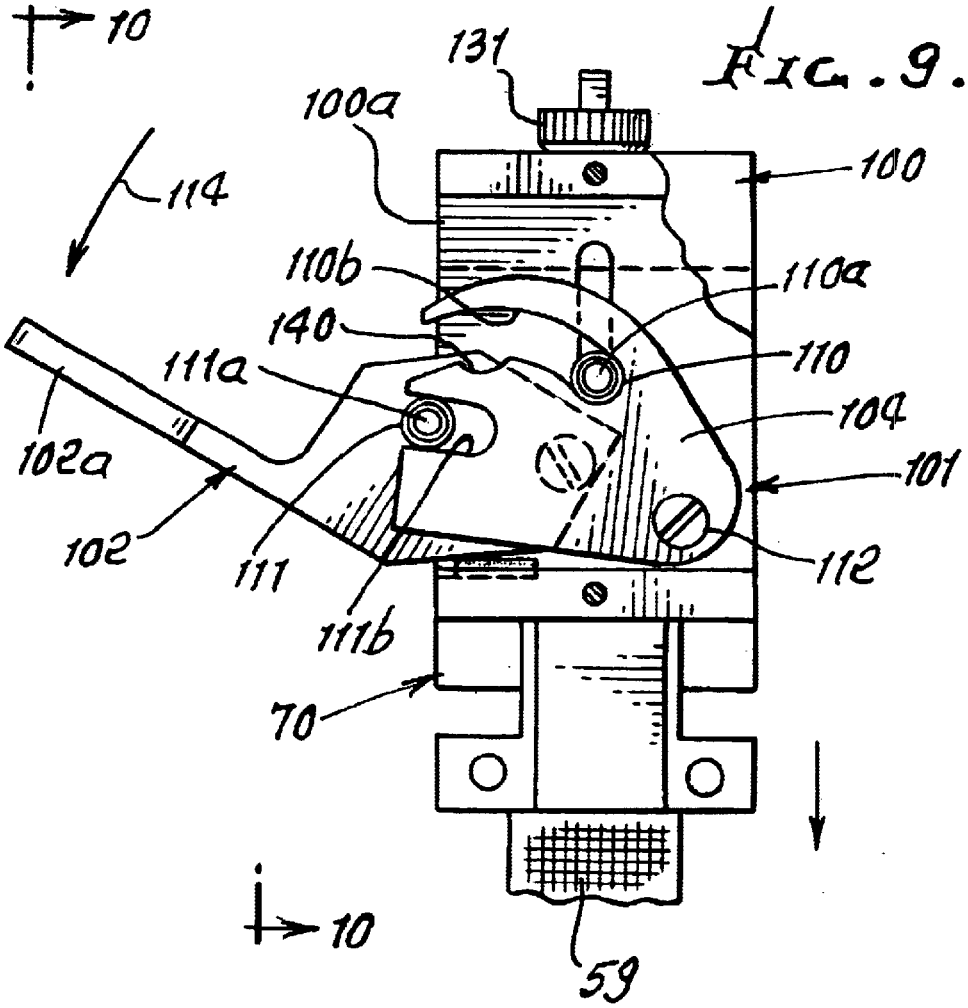
FIG. 9 is a view like FIG. 4 showing lever actuation.
Figure 10:
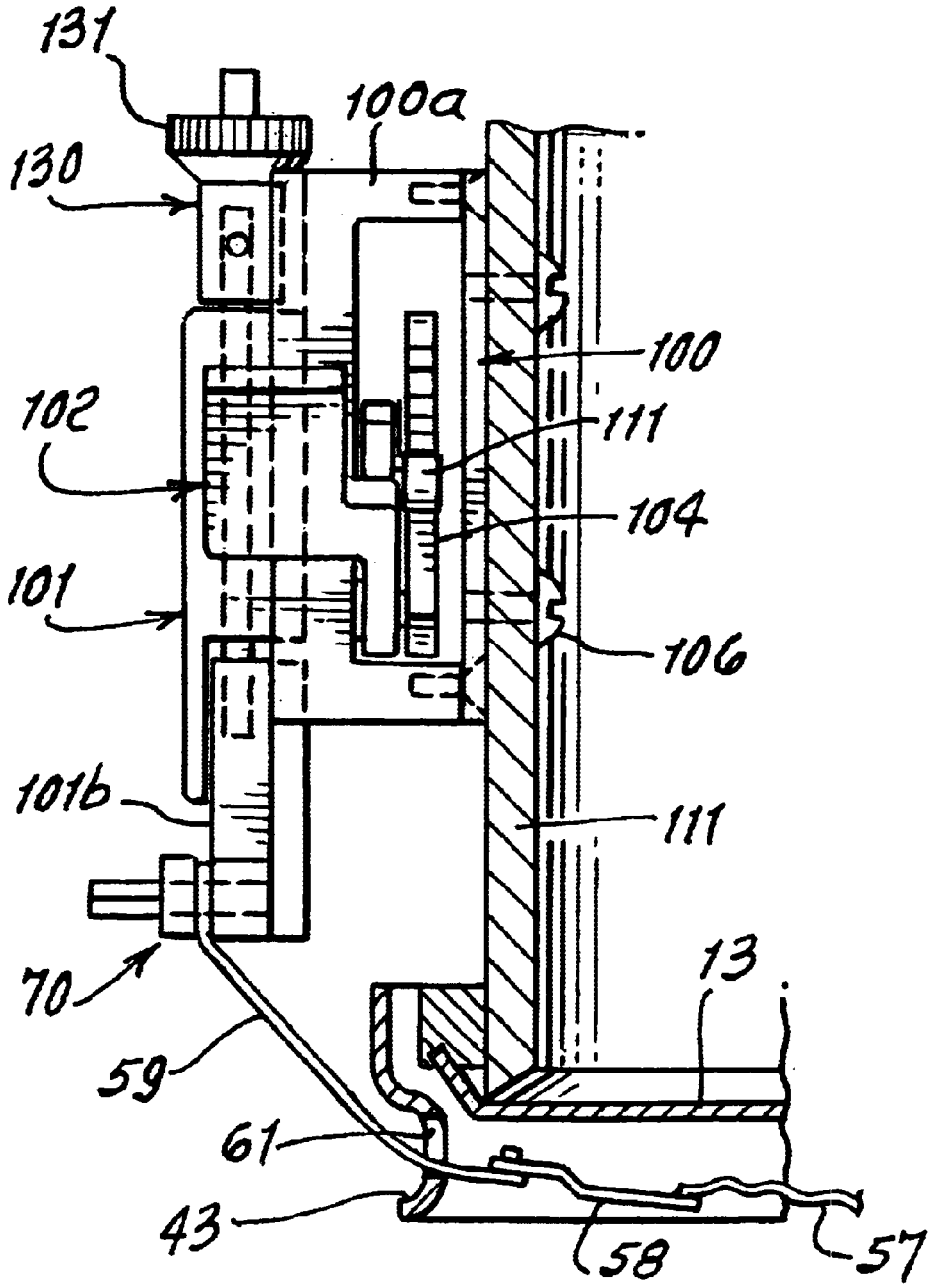
FIG. 10 is a frontal elevation taken on lines 10—10 of FIG. 9.

Referring to FIGS. 3–7, a strand tensioning throw-off device is shown, and includes:

a) a support body 100 shown as attachable to the side wall 11 of the drum;

b) a tensioning member 101 movable upwardly and downwardly relative to body 100 to tension or release the head striking strands 57 adjacent the drum head;

c) a lever 102 movable between selected positions, as for example are shown in FIGS. 4 and 9;

d) and anti-friction cam and follower roller elements that are relatively movable in response to such lever movement to effect the up and down movement of the tensioning member 101.

Typically, at least one of the described elements is or are carried by the lever; and the other or others of the element or elements is carried by the tensioning member, such as member 101. In the example, cam element 104 is carried by support body 100 in the form of a plate attached by fasteners 106 to the drum wall 11; and follower roller element or elements 110 and 111 are carried by axles 110*a* and 111*a* attached to the tensioning member 101, and to lever 102, respectively. Cam slots that receive the anti-friction rollers such as ball bearings are seen at 110*b* and 111*b*, in FIG. 9; and the cam is pivotally supported at 112 by body 100 to allow cam pivoting as between positions shown in FIGS. 4 and 9 as the lever itself is swung downwardly in direction 114 there being relative pivotal movement as between 102 and 104. Such downward swinging causes the roller elements 110 and 111 to move downwardly, and moves member 101 downwardly, as to FIG. 9 position, relieving the strands. The use of roller bearings quite substantially eases the lever and cam action, as well as contributes to overall compactness and guiding sturdiness of the assembly. A recess 140 in the side of slot 110*b* stabilizes seat roller 110 in FIG. 4 position. Also, the ends of the slots limit lever movement by engagement with the rollers, as shown.

Figure 8:
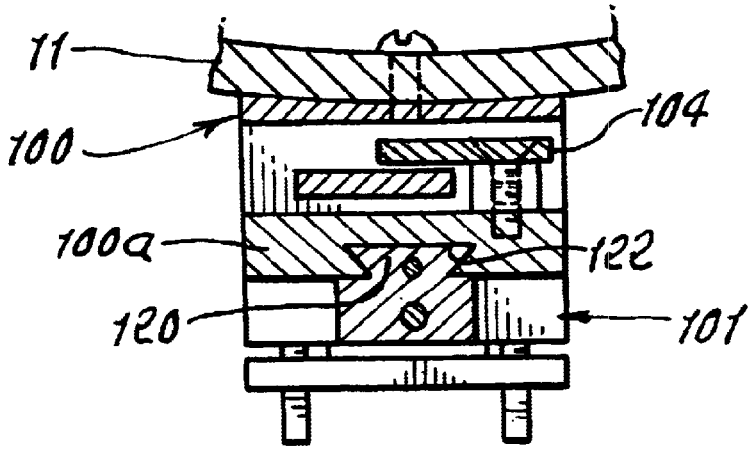
FIG. 8 is a horizontal section taken on lines 8—8 of FIG. 7.

Also shown, and of advantage, are a U-shaped portion 100*a* of the support body 100 housing the cam and roller bearings; and an elongated dove-tailed guide connection between portion 110*a* and the tensioning member 101. That guide includes a tongue 120 integral with the inner side 101*a* of member 101, and having vertical slide interfit in a trapezoidal shaped recess or groove 122 in portion 100*a* of body 100, as best seen in FIG. 8.

An adjuster 130 is provided to finely adjust strand tension. It has a rotatable handle 131 that projects above 100, and a screw thread connection at 132 to lower extent 101*b* of the tensioning member 101, to move 101*b* up or down relative to the upper extent 101*c* of member 101.

The ends of the strands 57 closest to the lever are connected at 58 to a strap 59 operatively connected to the member lower extent 101*b*. The latter is connected by releasable clamp 70 to the upper end of strap 59, the lower end of that strap extending through an opening 61 in the drum lower rim portion 43. As explained above, member 101 has operative connection with the lever to tension the strap and strands when the lever is swung upwardly, and to de-tension the strap and strands, when the lever is swung downwardly. Note lever handle 102*a*.

Figure 11:
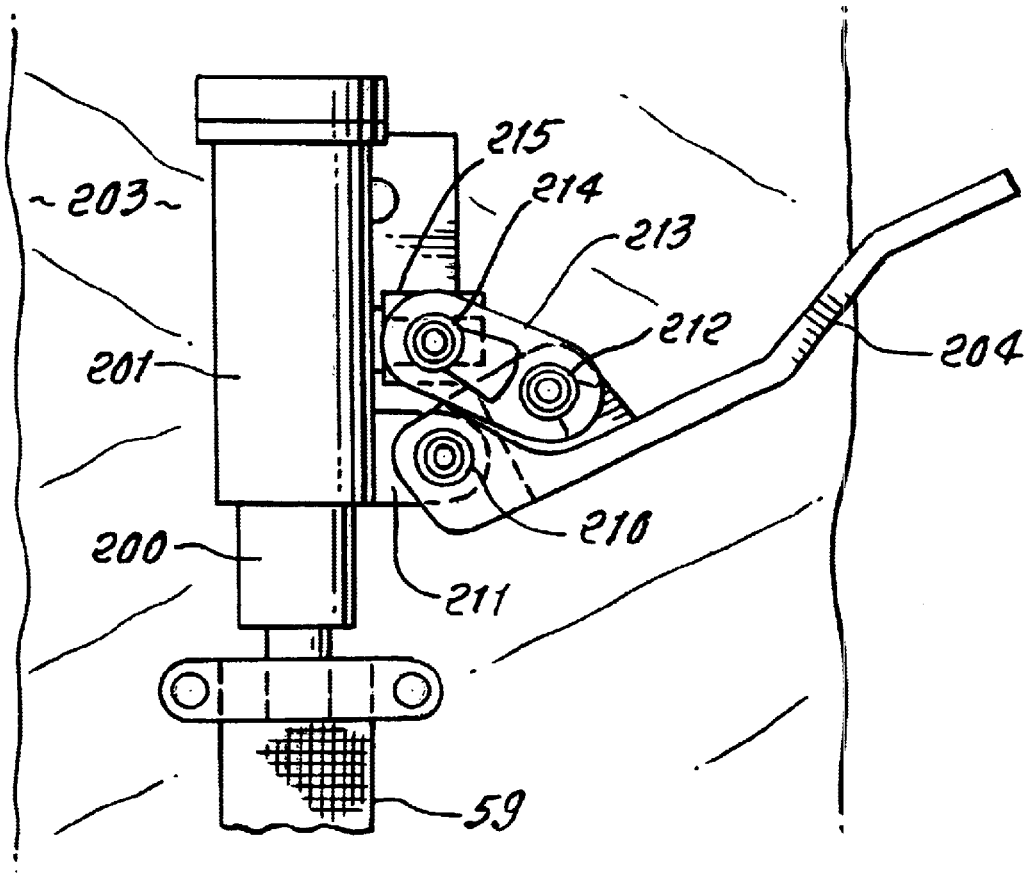
FIG. 11 is a frontal elevation showing a modification.

FIG. 11 shows a modification wherein a plunger 200 is movable up and down relative to a guide cylinder 201 attached to a drum wall 203. Plunger 200 is connected to a strap 59, which is in turn connected to strands as shown at 57 in FIG. 7.

A lever 204 has anti-friction roller bearing and link connection to the cylinder 201 and to the plunger, to move the plunger downwardly as the lever is swung in one direction, and vice versa. Note lever roller bearing connection at 210 to a tongue 211 attached to the plunger, and roller bearing connection at 212 to link 213, the latter having roller bearing connection at 214 to a tongue 215 attached to the cylinder.

Figure 7:
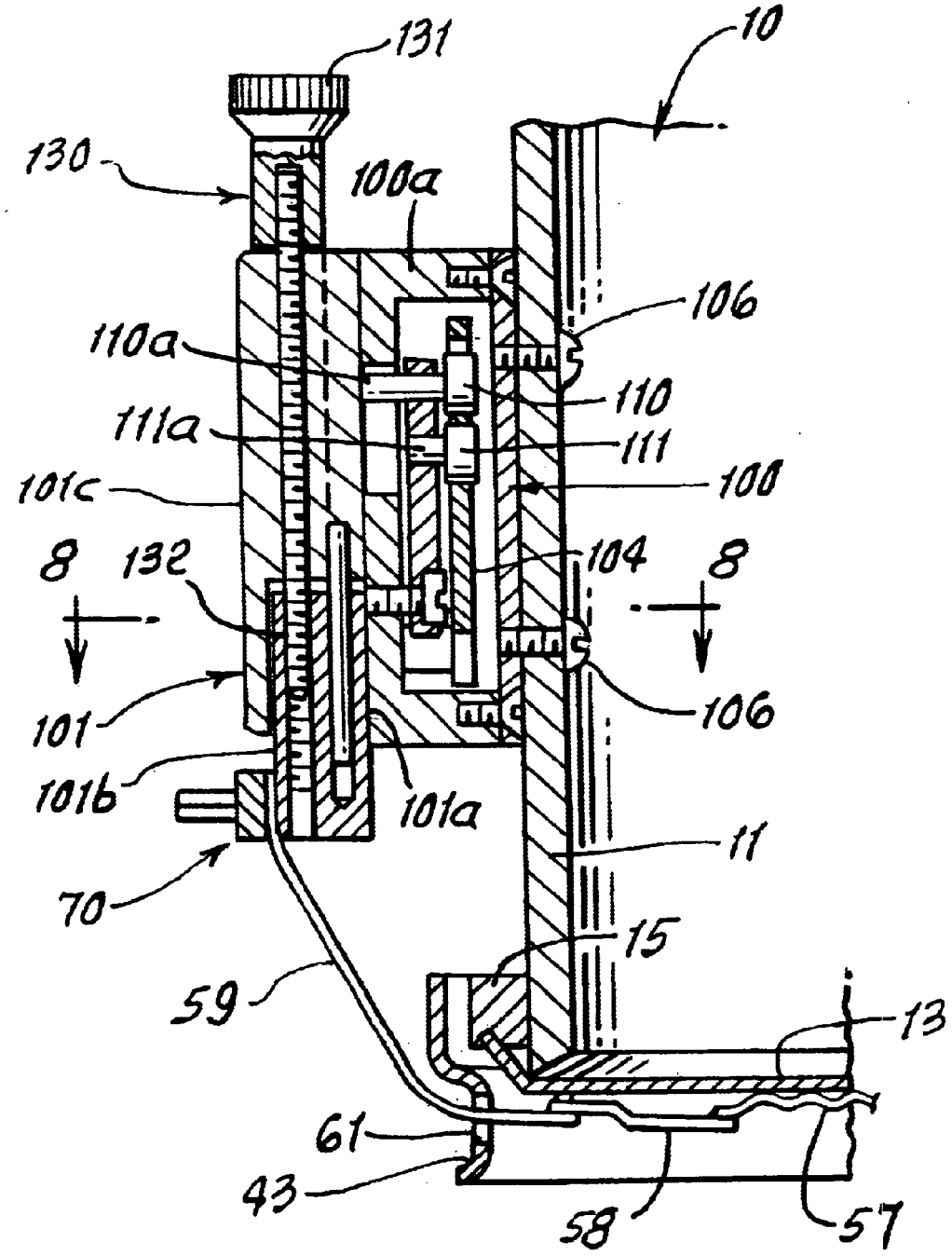
FIG. 7 is an elevation taken in section on lines 7—7 of FIG. 4.
Figure 12:
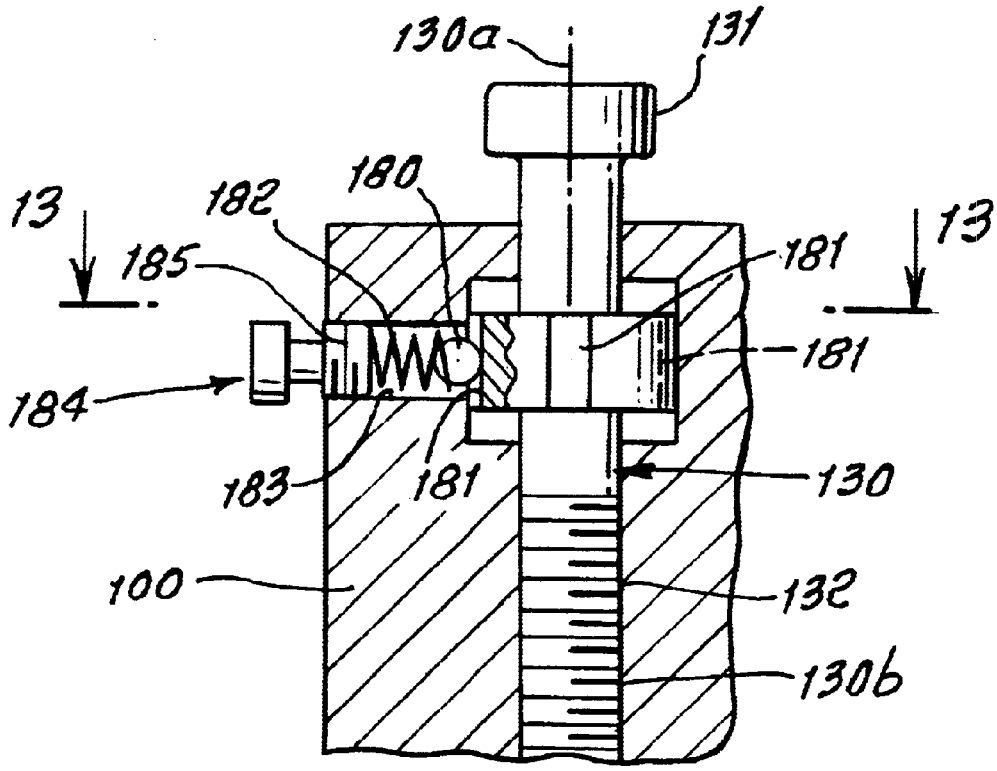
FIG. 12 is an enlarged fragmentary section showing detenting of a strand tensioning member.
Figure 13:
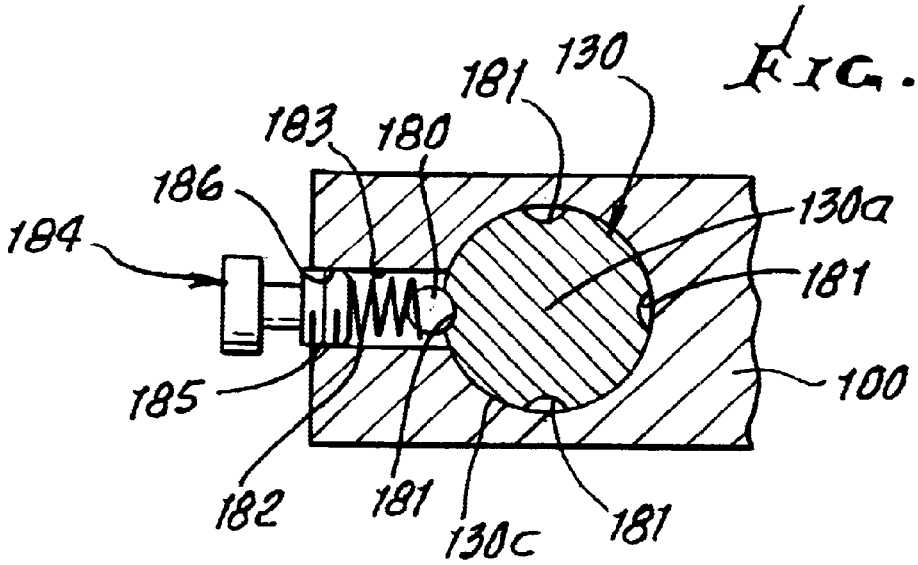
FIG. 13 is a section taken on lines 13—13 of FIG. 12.

In FIGS. 12 and 13 elements the same as in FIG. 7 bear the same identifying numerals. As seen in FIG. 12, strand tension adjuster 130 has a rotatable handle in the form of a knob 131 that projects above body 100, and a screw thread connection at 132 to lower extent 130*b* of member 130, to move up or down as knob 131 is rotated.

Detent means is provided for releasably holding said member in selected positions, whereby the degree of strand tensioning may be varied and retained at selected positions. The detent means yieldably blocks rotation of adjuster member 130 in any of a series of rotated positions of member 130. In its preferred form the detent means may include part 180, such as a ball, that is selectively and sequentially engageable with detent surfaces 181 on member 130, and spaced about its axis 130*a*. Thus, as member 130 is rotated, ball 180 rides against the rotating outer surface of a portion 130*c* of member 130 that defines detent surfaces 181, which may define shallow notches.

Such notches are typically configured to move endwise with member 130, and relative to the ball 180, while remaining capable of sequentially receiving the ball, as member 130 is rotated. For this purpose, the notches are typically elongated in the general direction of axis 130*a* of member 130. Member 130 and notches 181 move axially due to thread connection of 130 to member 100. Members 100 and 130 may alternatively be configured so that the notches do not move up and down, i.e. endwise, in which event they need not be elongated.

FIGS. 12 and 14 also show a compression spring 182 urging the ball 180 torward the side of 130*c*. Spring 182 may be non-adjustably retained in a bore 183 in 100; or, the spring may itself be adjustably urged toward the ball, as by a set screw 184, threaded at 185 into a bore 186 in 101. As that screw is rotated to move toward the spring, the spring compression is increased, and the detenting pressure of the ball against a selected notch is increased. This effect increases the yieldable "locking" of the member 130 in selected rotated position, at which the drum strands are tensioned, preventing inadvertent loosening of such tensioning.

Other detenting configurations to provide advantages as referred to, can be employed. The invention of FIGS. 11 and 12 is preferred.

I claim:

1. A throw-off device for use on a drum having a side wall and a head, comprising a) a support body attachable to the side wall of the drum, b) a tensioning member movable relative to said body to vary tension of strands adjacent the drum head, c) detent means for releasably holding said member in selected positions, whereby the degree of strand tensioning may be varied and retained at selected positions, d) a lever movable between selected positions, e) and cam and follower roller elements that are relatively movable in response to said lever movement to effect said member movement, f) said elements located in spaced relation to said detent means, g) said cam element located between said lever and one part of said support body attachable to said side wall of the drum; the cam element also being protected between the one part and a second part of the support body.

2. The device of claim 1 wherein said tensioning member is rotatable and said detent means yieldably blocks rotation of said member in any of a series of rotated positions of the member.

3. A throw-off device for use on a drum having a side wall and a head, comprising a) a support body attachable to the side wall of the drum, b) a tensioning member movable relative to said body to vary tension of strands adjacent the drum head, c) detent means for releasably holding said member in selected positions, whereby the degree of strand tensioning may be varied and retained at selected positions, d) and wherein said detent means includes a spring urged part sequentially and selectively engageable with detent surfaces on said member, and spaced about an axis defined by that member, e) said tensioning member being rotatable and said detent means yieldably blocking rotation of said member in any of a series of rotated positions of the member.

4. The device of claim 3 wherein said surfaces define notches spaced about said axis defined by said member.

5. The device of claim 1 wherein said means is carried by said support body.

6. The device of claim 1 wherein said strands are tensioned by said member.

7. The device of claim 4 wherein said member and said detent means are carried by said support body.

8. The device of claim 7 wherein said member is threadedly connected to said support body.

9. The device of claim 8 wherein said notches are elongated and movable in the direction of elongation of said tensioning member, and relative to said spring urged part, as said member is rotated relative to said support body.

10. The device of claim 3 including adjustable means to vary the tensioning of the spring, whereby the detenting force of engagement of said part with a detent surface may be adjusted.

11. The device of claim 1 wherein one of said elements is carried by said lever and another of said elements is carried by said tensioning member.

12. The device of claim 1 wherein said cam elements is on a plate.

13. The device of claim 1 wherein the roller element or elements are captivated in a guide slot or slots in the cam element.

14. The device of claim 13 wherein there are two of said guide slots in the cam element, one longer than the other, and the cam element is pivotally connected to the support body.

15. A throw-off device for use on a drum having a side wall and a head, comprising a) a support body attachable to the side wall of the drum, b) a tensioning member movable relative to said body to vary tension of strands adjacent the drum head, c) detent means for releasably holding said member in selected positions, whereby the degree of strand tensioning may be varied and retained at selected positions, d) a lever movable between selected positions, e) and cam and follower roller elements that are relatively movable in response to said lever movement to effect said member movement, f) said elements located in spaced relation to said detent means, g) the roller element or elements captivated in a guide slot or slots in the cam element, h) and including said strands, and a strap connecting the strands to said tensioning member, below said lever and said cam and follower elements.

16. In combination:

a) first and second components which are relatively moveable, b) drum head striking strands operatively connected to one of said components to be tensioned and de-tensioned in response to such movement, c) a lever having roller bearing operative connection to said components, to effect said movement thereof, d) and detent means for releasably holding one of said components in selected positions, whereby the degree of strand tensioning may be raised and retained at selected positions, e) said detent means including a spring urged part sequentially and selectively engageable with detent surfaces on one of said components, and spaced about an axis defined by the component.

17. The device of claim 16, wherein said one component has first and second sections which are relatively movable, one section connected to said drum head striking strands, and adjustment means to control said relative movement of said sections to effectively tune the striking action of the strands, when tensioned.

18. The combination of claim 13, wherein at least one slot has a side recess to seat a roller element and stabilize lever positioning.

19. A throw-off device for use on a drum having a side wall and a head, comprising a) a support body attachable to the side wall of the drum, b) a tensioning member movable relative to said body to tension or release strands adjacent the drum head, c) a lever movable between selected positions, d) and cam and follower roller elements that are relatively movable in response to said lever movement to effect said member movement, e) said roller elements being captivated in guide slots in the cam, at least one of said elements including a roller bearing or bearings, f) there being two of said guide slots in the cam, one longer than the other and curved along its length, the cam pivotably connected to the support body, g) said detent means for releasably holding said member in selected positions, whereby the degree of strand tensioning may be varied and retained at selected positions.

20. In combination in drum apparatus:

a) cam and follower components which are relatively moveable, b) drum head striking strands operatively connected to one of said components to be tensioned and de-tensioned in response to such movement, c) a lever having dual roller bearing operative connection to a first of said components, to effect said movement thereof relative to the other component, d) and detent means for releasably holding one of said components in selected positions, whereby the degree of strand tensioning may be varied and retained at selected positions, e) said detent means including a spring-urged part selectively engageable with detent surfaces on one of the components.

* * * * *